US008627977B2

(12) United States Patent
Newberry et al.

(10) Patent No.: US 8,627,977 B2
(45) **Date of Patent: *Jan. 14, 2014**

(54) TAMPER EVIDENT PLASTIC DISPENSING CONTAINER

(75) Inventors: Michael Newberry, Poplar Grove, IL (US); Joseph P. Valley, III, Roscoe, IL (US)

(73) Assignee: J.L. Clark, Inc., Rockford, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/610,280

(22) Filed: Sep. 11, 2012

(65) Prior Publication Data

US 2013/0001228 A1 Jan. 3, 2013

Related U.S. Application Data

(63) Continuation of application No. 12/103,985, filed on Apr. 16, 2008, now Pat. No. 8,292,111.

(60) Provisional application No. 60/912,574, filed on Apr. 18, 2007.

(51) Int. Cl.
*B65D 41/32* (2006.01)
*B65D 51/18* (2006.01)

(52) U.S. Cl.
USPC ..... 220/266; 220/254.2; 220/788; 222/556; 222/153.07; 222/541.5; 222/541.6

(58) Field of Classification Search
USPC ..... 220/212.5, 254.2, 254.3, 784, 788, 792, 220/793, 266, 326; 222/142.1, 153.06, 222/153.07, 457.5, 480, 541.4, 541.6, 556, 222/561; 215/43, 224, 317
See application file for complete search history.

(56) References Cited

U.S. PATENT DOCUMENTS

| | | | | |
|---|---|---|---|---|
| 3,034,693 | A | 5/1962 | Cox | |
| 3,251,509 | A | 5/1966 | Foster | |
| 3,255,928 | A | 6/1966 | Foster | |
| 3,370,757 | A | 2/1968 | Foster | |
| 3,845,872 | A | 11/1974 | Towns et al. | |
| 4,349,174 | A * | 9/1982 | Obrist et al. | 249/58 |
| 4,412,630 | A | 11/1983 | Daenen | |
| 4,621,744 | A | 11/1986 | Foster | |
| 5,052,572 | A | 10/1991 | Pherigo | |
| 5,730,352 | A | 3/1998 | Deekes | |
| 6,161,711 | A | 12/2000 | Micell et al. | |
| 6,422,411 | B1 | 7/2002 | Gray | |
| 7,021,482 | B2 | 4/2006 | Solowiejko | |
| 7,114,627 | B2 | 10/2006 | Solowiejko | |
| 7,845,519 | B2 | 12/2010 | Newberry et al. | |
| 2005/0035125 | A1 | 2/2005 | Bae | |
| 2005/0184070 | A1 * | 8/2005 | Boback et al. | 220/266 |
| 2007/0056972 | A1 | 3/2007 | Solowiejko | |
| 2007/0215619 | A1 | 9/2007 | Solowiejko | |
| 2011/0239597 | A1 | 10/2011 | Wilson et al. | |

* cited by examiner

*Primary Examiner* — Anthony Stashick
*Assistant Examiner* — James N Smalley
(74) *Attorney, Agent, or Firm* — Reinhart Boerner Van Deuren P.C.

(57) ABSTRACT

Tamper-resistance is provided in spice container closures and containers through use of tamper-evident and/or tamper-resistant elements. A tamper evident closure includes a base, a cover, and a tamper strip, with the tamper strip being joined to the base and cover by a first hinge connecting the tamper strip to the base and a second hinge connecting the tamper strip to the cover. At least one dispensing port in the base is selectively coverable by a flap of the cover. The tamper strip is adapted to be manually torn away and fully released from the cover and base. The flap is hinged to the cover by a third hinge. In addition, or alternatively, a snap lock connection is formed between a container closure and the container.

16 Claims, 10 Drawing Sheets

TAMPER EVIDENT PLASTIC DISPENSING CONTAINER

CROSS-REFERENCE TO RELATED PATENT APPLICATIONS

This patent application is a continuation of U.S. patent application Ser. No. 12/103,985, filed Apr. 16, 2008, which published as U.S. Publication No. 2009/0101647, which claims the benefit of U.S. Provisional Patent Application No. 60/912,574, filed Apr. 18, 2007, the entire teachings and disclosure of which are incorporated herein by reference thereto.

FIELD OF THE INVENTION

This invention generally relates to closures and/or containers of the type used for spices, or the like, and more particularly to tamper-resistant closures and/or containers.

BACKGROUND OF THE INVENTION

Numerous spice container closures and/or containers are known as exemplified by U.S. Pat. Nos.: 7,114,627; 7,021,482; 6,422,411; 5,052,572; 4,621,744; 3,370,757; 3,255,928; and 3,251,509; and U.S. Patent Publication No. 2007/0056972A1; all of which are assigned to the present assignee and all of which are hereby incorporated by reference in their entireties.

Although spice container closures and/or containers of the type exemplified in the patent documents listed above work well, further improvements are desirable, particularly with regard to making spice container closures and/or containers more tamper-resistant.

BRIEF SUMMARY OF THE INVENTION

The invention provides improvements in the tamper-resistance of spice container closures and/or containers through use of a container closure and/or container including tamper-evident and/or tamper-resistant elements.

In one form of the invention, a tamper evident closure includes a base, a cover, and a tamper strip, with the tamper strip being joined to the base and cover by a first hinge connecting the tamper strip to the base and a second hinge connecting the tamper strip to the cover. The base has at least one dispensing port extending therethrough, and the cover has at least one flap removably covering the at least one dispensing port. The first and second hinges may include a plurality of thin tearable webs, wherein the tamper strip is adapted to be manually torn away and fully released from the cover and base. The cover may include a support permanently secured to the base with the at least one flap being hinged to the support at a third hinge.

In some forms of the invention, the base may include a plurality of dispensing ports, and the cover may include a plurality of flaps with each of the plurality of flaps removably covering a corresponding one of the plurality of dispensing ports. The tamper evident closure may have a generally rectangular configuration adapted for a spice container.

In a tamper evident closure, according to the invention, the support portion of the cover may be plastically welded to the base. The tamper evident closure may also include an alignment and welding mechanism between the base and the cover for plastic welding the support to the base. The alignment and welding mechanism may include a plurality of weld posts received in a plurality of receiving pockets.

The base, of a tamper evident closure according to the invention, may include a platform and a pair of skirts depending downwardly from the platform, with the pair of skirts defining a receiving channel therebetween adapted to receive a top free edge of a container.

The cover, of a tamper evident closure according to the invention, may be disposed on top of the base in a substantially parallel manner to form a juncture between the cover and the base. The first and second hinges and the tamper strip join the cover to the base along adjacent edges of the top end base, in such a manner that the tamper strip spans the juncture between the base and the cover. In some forms of the invention, the base, the cover, the tamper strip and the hinges are a one piece integrally molded component. The one piece integrally molded component may be configured such that the cover may be folded on top of the base via the hinges and the tamper strip.

The invention may also take the form of a package including a container, a closure, and a tamper shield. The container has a side wall terminating in a free edge, and the closure includes a platform and an inner and outer skirts depending downwardly from the platform. The inner and outer skirts define a receiving channel therebetween adapted to receive the free edge of the container. The tamper shield is integrally formed around the container in a spaced relation to the free edge transitioning a perimeter of the side wall to be similar to a perimeter of the outer skirt.

A package, according to the invention, may also include a snap lock connection between the side wall of the container and the closure. The snap lock connection may include a plurality of locking tabs and locking slots. The tabs and slots are configured to interlock in the receiving channel. The locking tabs may be formed proximate the free edge of the side wall of the container, in a spaced relation to the tamper shield, with the locking slots being formed on the outer skirt of the closure. The locking tabs and tamper shield may be integrally plastic molded portions of the container. The locking tabs may be wedge shaped and adapted for facilitating camming insertion of the side wall into the receiving channel.

In some forms of the invention, the closure is a generally rectangular serving lid having a base with a plurality of dispensing ports and a cover with a plurality of flaps removably covering the dispensing ports respectively.

A package, according to the invention, may include a container, a closure, and a snap lock connection between the container and the closure. The container has a generally rectangular side wall terminating in a free edge. The closure includes a platform and generally rectangular inner and outer skirts depending downwardly from the platform. The inner and outer skirts define a receiving channel therebetween which is adapted to receive the free edge of the container. The snap lock connection is disposed between the side wall of the container and the closure.

The snap lock connection may include a plurality of locking tabs and locking slots interlocking in the receiving channel. The locking tabs may be formed proximate the free edge of the side wall of the container, and the locking slots may be formed on the outer skirt of the closure, with the locking slots being integrally plastic molded portions of the closure. The closure may be a generally rectangular serving lid having a base with a plurality of dispensing ports and a cover with a plurality of flaps removably covering the dispensing ports respectively.

Other aspects, objectives and advantages of the invention will be apparent from the following detailed description in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1A:
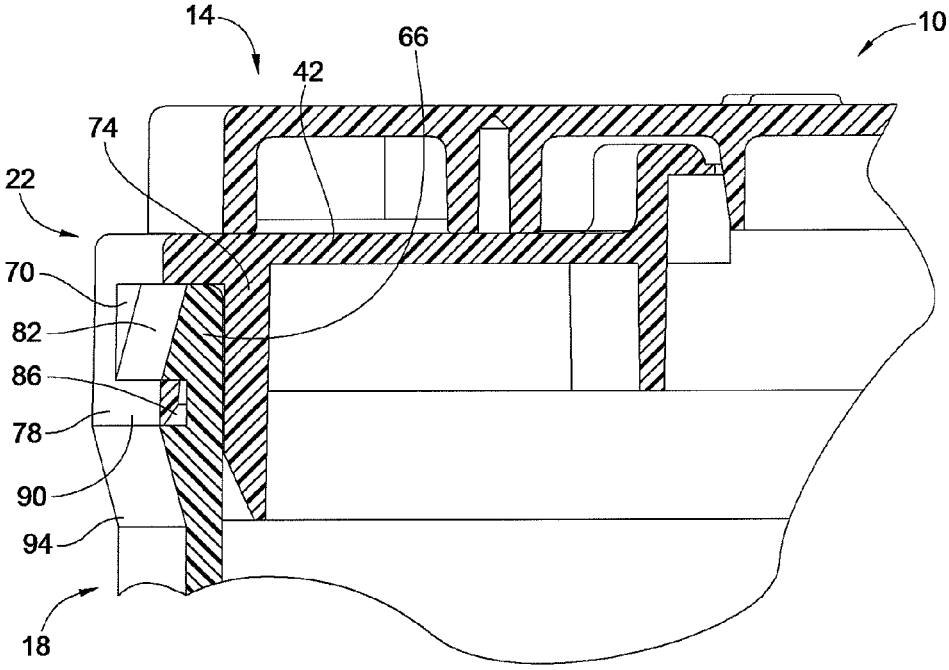
FIG. 1*a* is a cross section of a top upper portion of a spice container package shown in isometric, in accordance with an embodiment of the present invention.
Figure 1B:
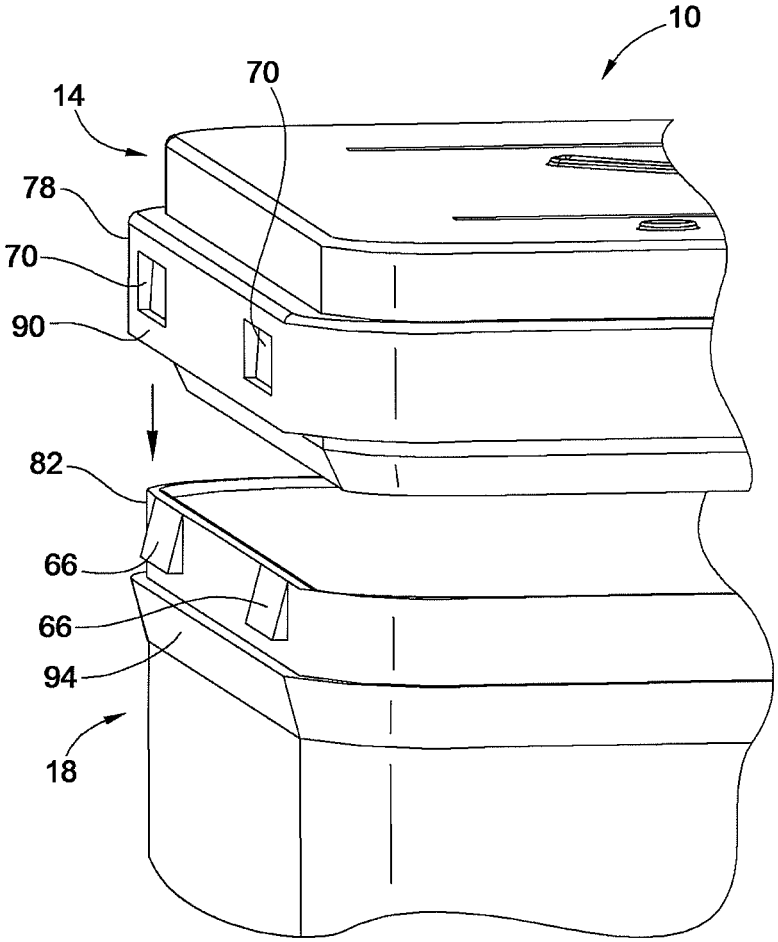
FIG. 1*b* is an isometric exploded assembly view of a serving lid closure and a container of the spice container package shown in FIG. 1*a;*
Figure 2:
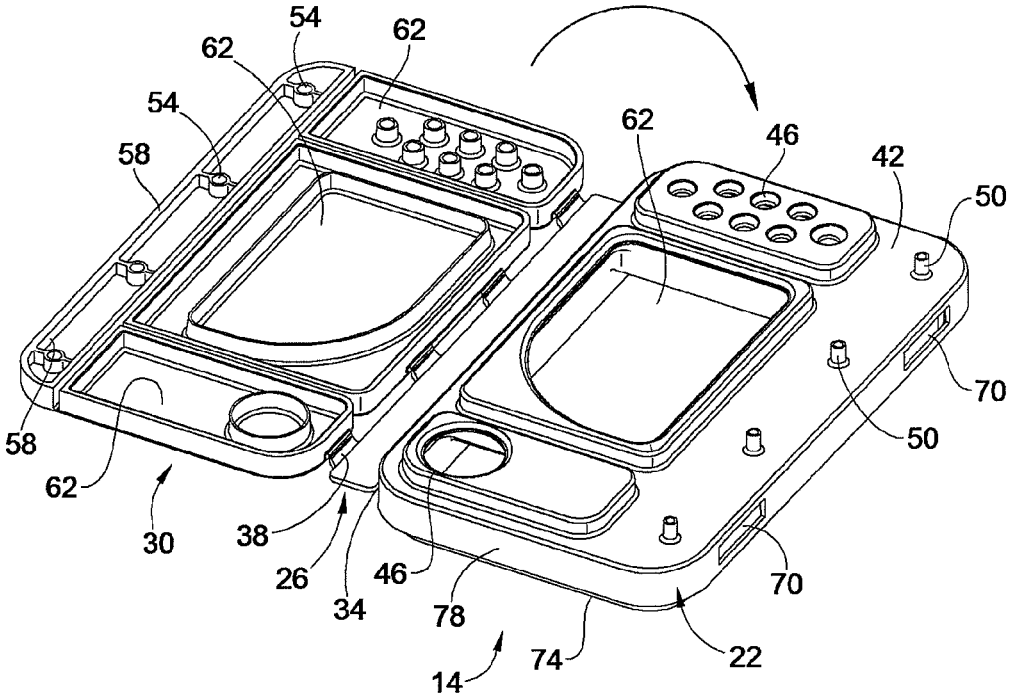
FIG. 2 is an isometric view of a serving lid closure shown in prior figures.
Figure 3:
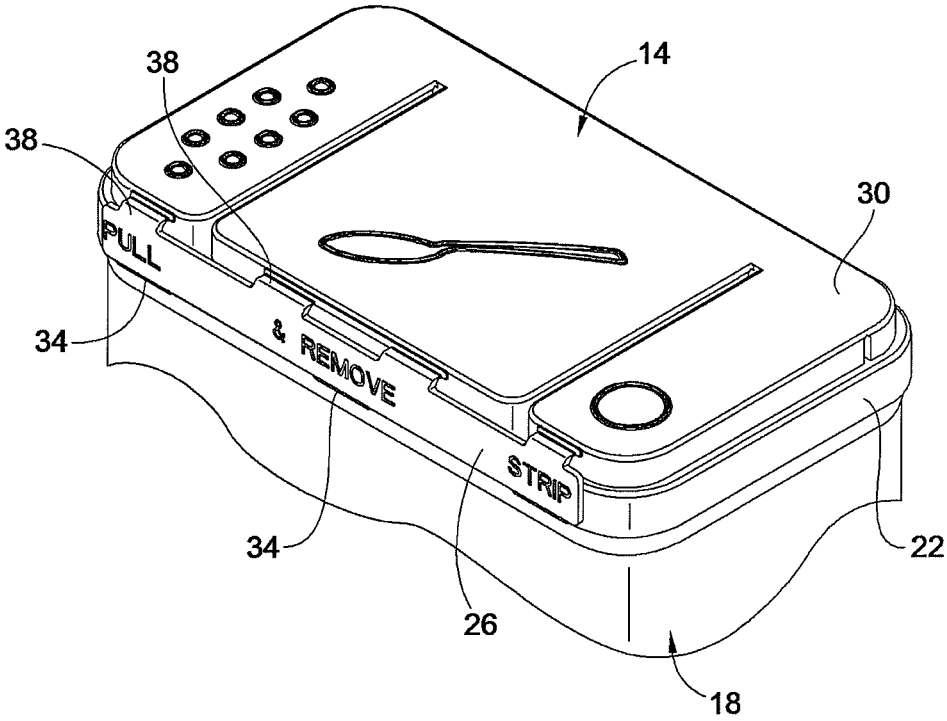
FIG. 3 is a frontal isometric view of the assembled spice container package showing the tamper evident strip along a front thereof.
Figure 4:
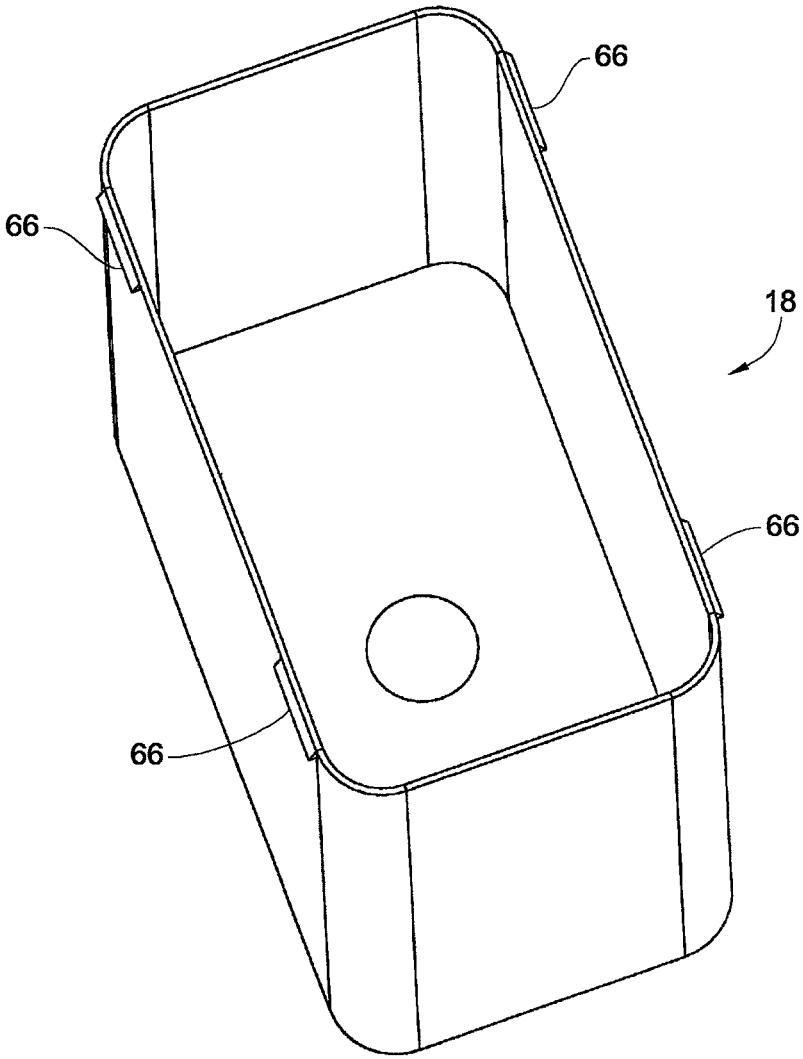
FIG. 4 is top isometric view of a container for use with the serving lid closure of the disclosed embodiments, except that this container embodiment does not include a tamper shield.
Figure 5:
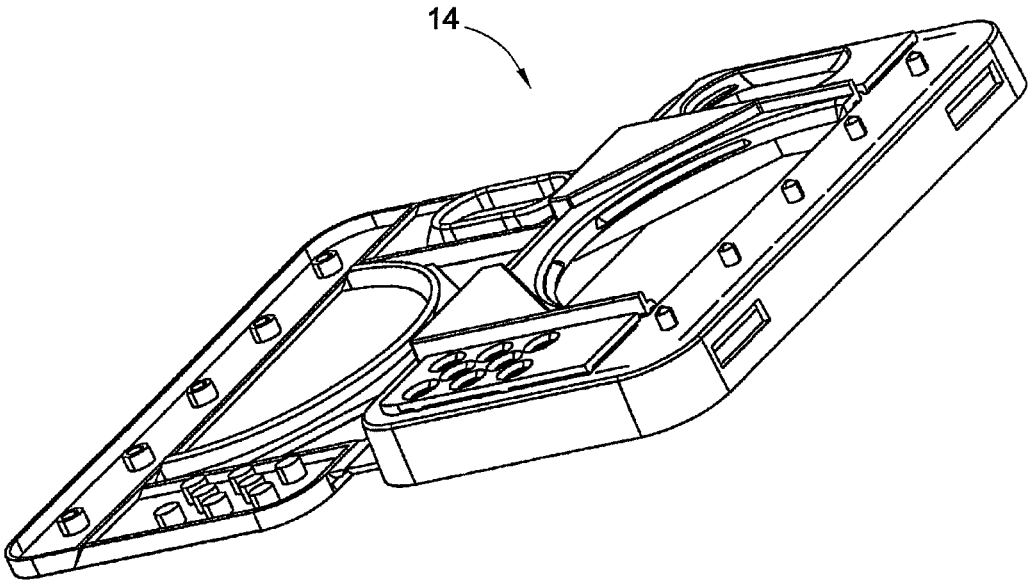
FIGS. 5 and 6 are different top side isometric views of the serving lid closure.
Figure 6:
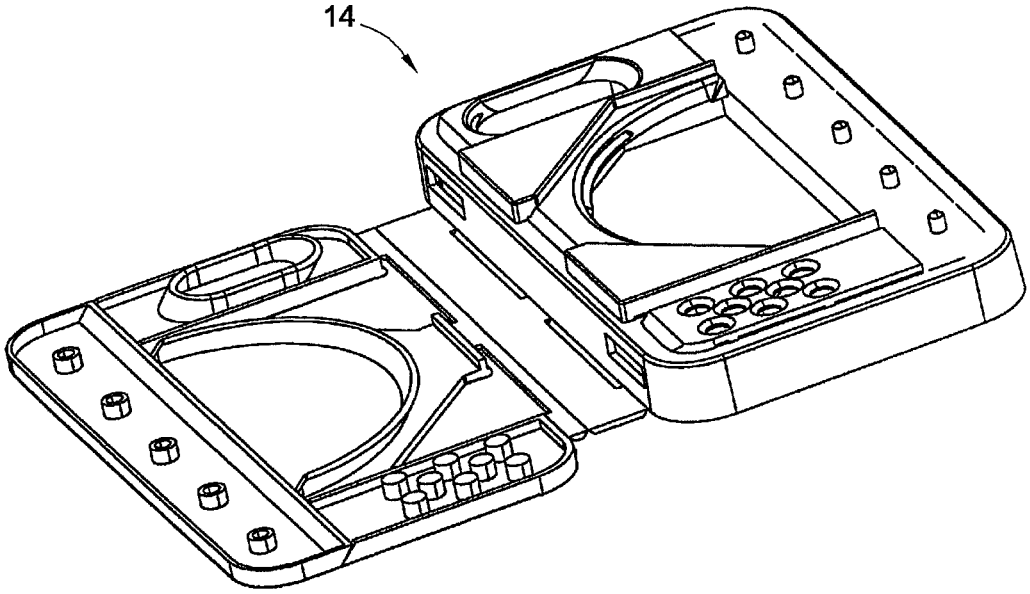
Figure 7:
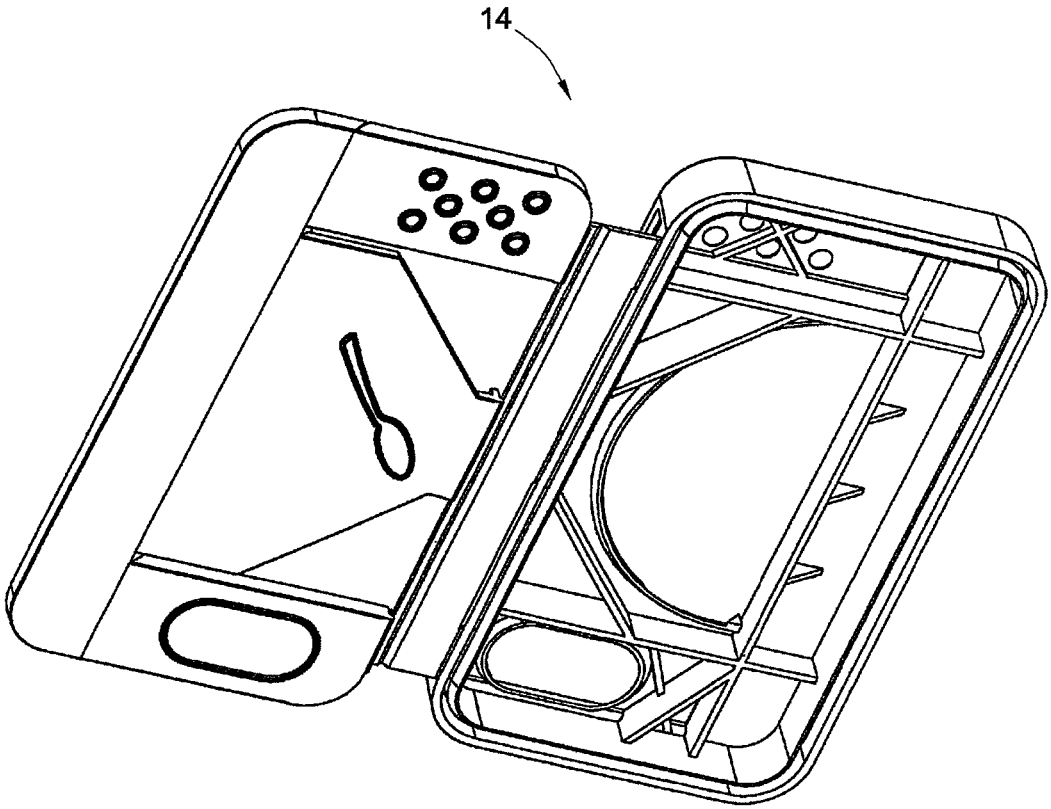
FIG. 7 is a bottom side isometric view of the serving lid closure.
Figure 8:
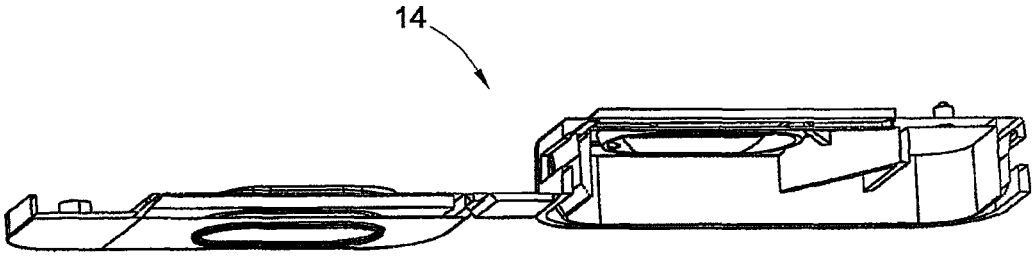
FIG. 8 is a cross section of an isometric view of the serving lid closure.
Figure 9:
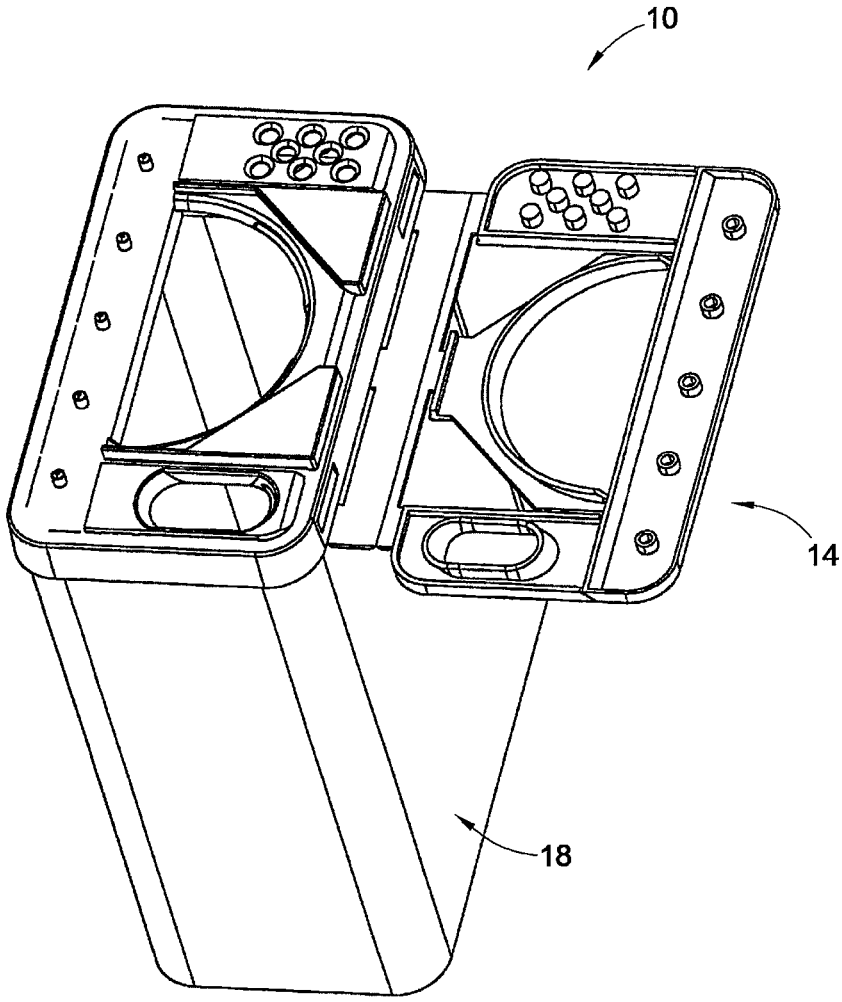
FIG. 9 is a top isometric view of the spice container package.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In the figures, an embodiment of the present invention is shown as a spice container package 10 including a serving lid closure 14 and a container 18. The serving lid closure 14 is molded of plastic material and preferably the container 18 is also molded of plastic material. However the serving lid closure 14 and one or more of its features may be employed with a metal container and readily adapted therefore as shown, for example in various prior patents issued to the Applicant including those previously referenced. Also as shown, preferably, the spice container package is generally rectangular in configuration similar to many of the spice container packages as seen in supermarkets. However, inventive features may also be employed in non-rectangular package designs and/or in other closures.

The serving lid closure 14 is preferably a one piece integrally molded plastic member as shown in the drawings. As such, multiple molding of separate parts may not be necessitated. Additionally, the serving lid closure 14 can be molded using relatively simple molding technique between two mold halves potentially with a one pull mold process (slots 70 in outer skirt may be formed with pins from the side or may permit resilient mold release through slight flexure).

The serving lid closure 14 generally includes a base 22, a tamper strip 26 and a cover 30. The tamper strip 26 is disposed intermediate the base 22 and cover 30 and joined to each of the two respective components by virtue of integral hinges 34 and 38, which are very thin segments of plastic material which allow the cover to be folded over and pivoted to on top of the base 22. Additionally, the hinges 34 and 38 are also sufficiently thin to allow for manual removal and tearing such that tamper strip 26 also serves as a tear strip that can be manually removed relatively easily through manual manipulation. Typically the tamper strip 26 will include printed indicia on its front face indicating that it can be pulled and removed or otherwise indicating that it is a feature evident of tampering.

The container base 22 includes a platform 42 through which a plurality of dispensing ports 46 are formed (e.g., such as a spoon port, a sift port and a pour port as shown). Additionally, the base 22 and cover 30 include an alignment and welding mechanism comprising welding posts 50 and receiving pockets 54. In the disclosed embodiment, the welding posts 50 are on the base 22 while the pockets 54 are formed into bosses on the cover 30, however the reverse arrangement may be true. When the cover 30 is folded over the base 22, the welding post 50 are received in the pockets 54 (tapers on either or both of these structures can facilitate alignment) and the cover and base are then permanently joined such as plastic welding (e.g. an ultrasonic or other appropriate permanent type weld), glue, staking, or other appropriate securing mechanism. As shown, the pockets 54 are formed along a support 58. The support 58 has hinged thereto a plurality of flaps 62, each which is independently movable to selectively cover or open one of the dispensing ports 46, to allow for selective manual access to the dispensing ports 46 when in use. The hinges for the flaps 62 are sufficiently thin segments of plastic to allow for pivoting motion and also sufficiently thick so as to prevent inadvertent manual tear away.

A different aspect of the disclosed embodiment which can be used and employed independent of the tamper strip related features is the provision for reliably and preferably permanently locking the serving lid closure 14 to the container 18. Between the container 18 and serving lid closure 14 is provided a mounting interface with interacting snap structures located at discrete locations including as shown locking tabs 66 and locking slots 70. In the disclosed embodiment, the locking tabs 66 are formed proximate the top of the container side wall (at opposing ends and/or opposing sides), while complimentary locking slots 70 are formed into the serving lid closure 14. Alternatively or in addition, the closure 14 can be staked, welded, glued or otherwise secured to the container via a different securing mechanism.

As shown, the serving lid closure 14 includes an inner rectangular skirt 74 and an outer rectangular skirt 78, which both depend downwardly from the platform 42. The inner skirt 74 is slidably received and may engage the inner surface of the container 18 proximate a top and thereof. The outer skirt 78 which defines the locking slots 70 is received over the exterior surface of the side wall of the container 18. To assist in assembly, cam surfaces 82 and 86 are provided to facilitate temporary flexing of the outer skirt 78 outwardly away relative to the side wall of the container 18 during assembly, to thereby allow the locking tabs 66 to snap into the locking slots 70 (e.g. note the locking tabs 66 may be in the form of a wedge). Upon receipt of the locking tabs 66 into the locking slots 70, locking segments 90 formed along the lower edge of the locking slots 70 of the outer skirt 78 release back inwardly to engage the underside of the locking tab 66 to permanently secure the container 18 to the serving lid closure 14, thereby to prevent easy manual removal/tampering. As shown after assembly, the resilient flexure in the outer skirt 78 is relieved once it is allowed to flex back inwardly after it clears the underside of the locking tabs 66.

Preferably, a tamper shield 94 which transitions the container sidewall to a thickness about the same (or greater if desired) than the perimeter of the outer skirt 78 is provided so as to prevent easy manual manipulation of the locking segments 90 which could allow for tampering of the serving lid closure. The tamper shield preferably extends around the periphery of the container sidewall and may be a triangular thickened region of the sidewall as shown. Thus, the design provides a mechanical lock between the closure 14 and the container 18 to greatly reduce the possibility of removal without causing visual damage to one or both of the components, particularly without the availability of tools.

To assemble the device, the cover of the serving lid closure is folded relative to and welded to the base (or alternatively, otherwise permanently joined such as by gluing, stacking or other methods). Thereafter (or alternatively prior to the first step), the serving lid closure and the container are pushed together in order to permanently lock the serving lid closure to the container utilizing the snap structures. Thereafter, the consumer must remove the tamper evident strip in order to access the product such as spices, dry flowable granular product or other product that may be contained within the container.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tamper evident closure, comprising:
a base having at least one dispensing port therethrough;
a cover having at least one flap removably covering the at least one dispensing port;
a tamper strip;
a first hinge connecting the tamper strip to the base; and
a second hinge connecting the tamper strip to the cover;
wherein the cover includes a support secured to the base, the at least one flap being hinged to the support at a third hinge, the third hinge oppositely disposed from the first hinge and the second hinge.

2. The tamper evident closure of claim 1, wherein the base, the cover, the tamper strip, the first hinge, the second hinge, and the third hinge are a one piece integrally molded component.

3. The tamper evident closure of claim 1, further comprising an at least one alignment structure between the base and the cover for securing the cover to the base, the at least one alignment structure is located on the support such that the support is a raised plane parallel to and above a plane that contains the base.

4. The tamper evident closure of claim 1, wherein the first and second hinges comprise a plurality of thin tearable webs, wherein the tamper strip is adapted to be manually torn and fully released from the cover and the base.

5. A tamper evident closure, comprising:
a base having at least one dispensing port therethrough;
a cover having at least one flap removably covering the at least one dispensing port;
a tamper strip;
a first hinge connecting the tamper strip to the base; and
a second hinge connecting the tamper strip to the cover;
wherein the first and second hinges comprise a plurality of thin tearable webs, wherein the tamper strip is adapted to be manually torn and fully released from the cover and the base;
wherein the cover includes a support secured to the base, the at least one flap being hinged to the support at a third hinge.

6. The tamper evident closure of claim 5, wherein the third hinge is oppositely disposed from the first hinge and the second hinge.

7. The tamper evident closure of claim 5, wherein:
the base includes a plurality of the dispensing ports;
the cover includes a plurality of the flaps with each of the plurality of flaps removably covering a corresponding one of the plurality of dispensing ports; and the tamper evident closure has a generally rectangular configuration adapted for a spice container.

8. The tamper evident closure of claim 5, wherein the support is plastically welded to the base.

9. The tamper evident closure of claim 8, further comprising an alignment and welding mechanism between the base and the cover for plastic welding the support to the base, the alignment and welding mechanism including a plurality of weld posts received in a plurality of receiving pockets.

10. The tamper evident closure of claim 5, wherein the base includes a platform and a pair of skirts depending downwardly from the platform, the pair of skirts defining a receiving channel therebetween adapted to receive a top free edge of a container.

11. The tamper evident closure of claim 5, wherein, the cover is disposed on top of the base in a substantially parallel manner to form a juncture between the cover and the base, with the first and second hinges and the tamper strip joining the cover to the base along adjacent edges of the cover and base, and the tamper strip spanning the juncture between the base and cover.

12. The tamper evident closure of claim 5, wherein the base, the cover, the tamper strip and the hinges are a one piece integrally molded component.

13. The tamper evident closure of claim 12, wherein the cover is folded on top of the base via the hinges and the tamper strip.

14. A method of providing a tamper strip on a container, comprising:

connecting a tamper strip to a base along a first pivot location;

connecting the tamper strip to a cover along a second pivot location spaced from the first pivot location; and folding the cover on top of the base by pivoting the tear strip relative to the base about the first and second pivot locations;

securing the cover to the base at a support structure disposed on a plane that is parallel to and elevated from a plane that contains the base.

15. The method of claim 14, wherein the base includes at least one dispensing port therethrough and the cover includes at least one flap removably covering the at least one dispensing port.

16. The method of claim 15, further comprising hinging the at least one flap at a third pivot location located on the support structure and oppositely disposed from the first pivot location and the second pivot location.

* * * * *